US011274012B2

(12) United States Patent
Egawa

(10) Patent No.: US 11,274,012 B2
(45) Date of Patent: Mar. 15, 2022

(54) SHEET BINDING DEVICE AND IMAGE FORMING APPARATUS

(71) Applicant: KYOCERA Document Solutions Inc., Osaka (JP)

(72) Inventor: Keisuke Egawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/098,500

(22) Filed: Nov. 16, 2020

(65) Prior Publication Data

US 2021/0155443 A1 May 27, 2021

(30) Foreign Application Priority Data

Nov. 22, 2019 (JP) ..... JP2019-211439

(51) Int. Cl.
*B65H 37/04* (2006.01)
*B65H 43/08* (2006.01)
*B42C 1/12* (2006.01)

(52) U.S. Cl.
CPC ..... *B65H 43/08* (2013.01); *B42C 1/12* (2013.01); *B65H 37/04* (2013.01)

(58) Field of Classification Search
None
See application file for complete search history.

(56) References Cited

U.S. PATENT DOCUMENTS 5,033,731 A * 7/1991 Looney ..... B65H 43/06 271/176
6,550,757 B2 * 4/2003 Sesek ..... B27F 7/17 227/2
7,537,205 B2 * 5/2009 Nagata ..... B42B 5/103 270/58.07
8,444,133 B2 * 5/2013 Kimura ..... B65H 31/24 270/58.08
9,917,980 B2 * 3/2018 Ooba ..... G06F 3/1258
9,944,488 B2 * 4/2018 Kunieda ..... B42B 5/00
10,029,880 B2 * 7/2018 Ishihara ..... B31F 5/001
10,089,563 B2 * 10/2018 Kondo ..... G03G 15/6544
10,093,511 B2 * 10/2018 Okada ..... G03G 15/6544

FOREIGN PATENT DOCUMENTS

JP 2016-146203 8/2016

* cited by examiner

*Primary Examiner* — Leslie A Nicholson, III
(74) *Attorney, Agent, or Firm* — Lex IP Meister, PLLC

(57) ABSTRACT

A sheet binding device includes a first binding unit that performs a first binding process of binding a sheet bundle having a first thickness or less without using a staple, and a second binding unit that performs a second binding process of binding the sheet bundle having a second thickness or less exceeding the first thickness using a staple, the first binding process by the first binding device is preferentially executed when the thickness of the sheet bundle is the first thickness or less, and the second binding process by the second binding unit is executed when the thickness of the sheet bundle exceeds the first thickness and is equal to or less than the second thickness.

6 Claims, 7 Drawing Sheets

SHEET BINDING DEVICE AND IMAGE FORMING APPARATUS

INCORPORATION BY REFERENCE

This application is based upon and claims the benefit of priority from the corresponding Japanese Patent Application No. 2019-211439 filed on Nov. 22, 2019, the entire contents of which are incorporated herein by reference.

BACKGROUND

The present disclosure relates to a sheet binding device capable of performing two types of binding processing and an image forming apparatus.

Some image forming apparatuses include a sheet binding device capable of selectively performing, between binding processing without using a staple and binding processing using a staple, with respect to the sheet after the image formation is performed.

Generally, the staple binding processing can bind a larger number of sheets than the staple-free binding processing.

However, the number of sheets that can be stapled by the staple-free binding processing and the staple binding processing varies depending on the thickness of the sheet.

Therefore, it is known that the number of sheets that can be stapled by the staple-free binding processing is set for each type of sheet, and whether or not to execute the staple-free binding processing is controlled according to the type of sheet and the number of sheets to be processed.

SUMMARY

A sheet binding device according to an aspect of the present disclosure includes a processing tray, a first binding unit, a second binding unit, a thickness detection unit, and a binding control unit. The processing tray is stacked with a sheet bundle formed by stacking a predetermined number of sheets to be carried in. The first binding unit performs a first binding process for binding the sheet bundle having a thickness of equal to or less than a first thickness without using a staple. The second binding unit can perform a second binding process for binding the sheet bundle having a thickness of equal to or less than a second thickness exceeding the first thickness, using a staple. The first thickness detection unit detects a first state in which a thickness of the sheet bundle exceeds the first thickness. The number counting unit counts the number of sheets of the sheet bundle. When the number of sheets counted by the number counting unit reaches a designated number of sheets, the binding control unit executes the first binding process by the first binding unit when the first thickness detection unit does not detect the first state, and executes the second binding process by the second binding unit when the first thickness detection unit detects the first state.

DETAILED DESCRIPTION

Hereinafter, embodiments of the present disclosure will be described with reference to the drawings.

It should be noted that the following embodiments are merely examples of the present disclosure, and do not limit the technical scope of the present disclosure.

[Configuration of Image Forming Apparatus 100]

Figure 1:
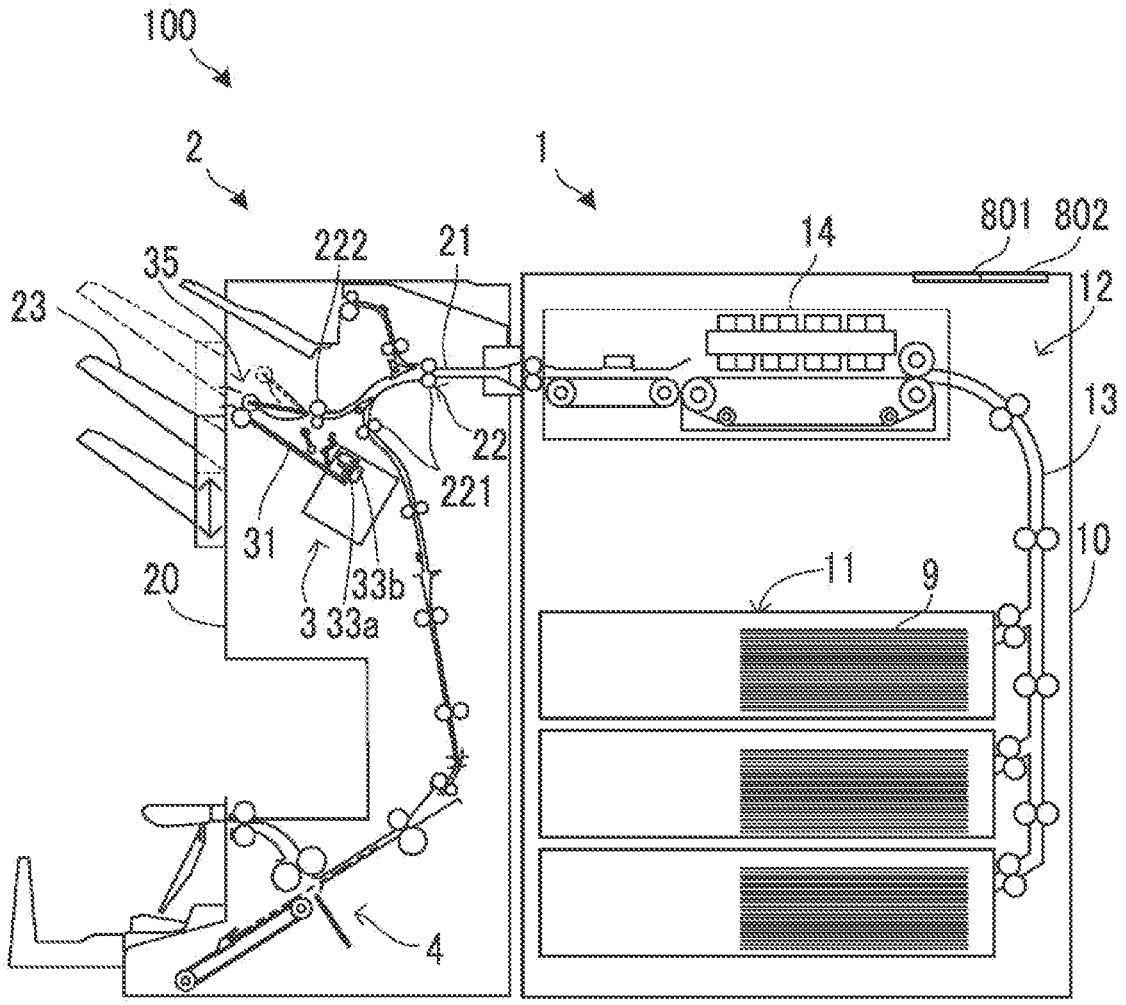
FIG. 1 is a configuration diagram of an image forming apparatus including a sheet binding device according to an embodiment.

As shown in FIG. 1, a sheet binding device 3 according to the embodiment constitutes a part of an image forming apparatus 100. The image forming apparatus 100 includes a main body unit 1 and a post-processing unit 2.

The post-processing unit 2 is connected to the main body unit 1.

The main body unit 1 includes a sheet supply unit 11, a first sheet conveyance device 12, a first conveyance path 13, and a printing apparatus 14, which are provided in a main body chassis 10.

Further, the main body unit 1 also includes a control device 8, an operation device 801, a display device 802, and the like.

The operation device 801 is a device that accepts an operation of a user. For example, the operation device 801 includes one or both of a touch panel and an operation button.

The display device 802 displays a menu screen related to an operation on the operation device 801 or other information.

The first sheet conveyance device 12 conveys the sheets 9 accommodated in the sheet supply unit 11 along the first conveyance path 13 one by one. a printing apparatus 14 executes printing processing on the sheet 9 conveyed along the first conveyance path 13.

For example, the printing apparatus 14 executes the printing processing of the inkjet system. Note that the printing apparatus 14 may be a device that executes printing processing of the electrophotographic method or the other method.

The first sheet conveyance device 12 conveys the sheet 9 on which an image is formed from an outlet of the first conveyance path 13 toward the post-processing unit 2.

The post-processing unit 2 includes a second conveyance path 21, a second sheet conveyance device 22 and a sheet binding device 3 provided in a post-processing housing 20, and a discharge tray 23 provided outside the post-processing housing 20.

The sheet 9 sent from the main body unit 1 to the post-processing unit 2 is carried into the second conveyance path 21. The second sheet conveyance device 22 includes a plurality of pairs of conveyance rollers 221 that convey the sheet 9 along the second conveyance path 21.

Further, the second sheet conveyance device 22 includes a sending roller pair 222 that feeds the sheet 9 to the sheet binding device 3.

In the example shown in FIG. 1, the post-processing unit 2 further includes a sheet folding device 4 provided in the post-processing housing 20. The sheet folding device 4 performs a folding process on the sheet 9.

The sheet binding device 3 performs a first binding process or a second binding process on a plurality of sheets 9 on which an image has been formed by the printing apparatus 14. The first binding process is staple-free binding processing for binding a plurality of sheets 9 without using a staple. The second binding process is staple binding processing for binding a plurality of sheets 9 by using a staple. Details of the sheet binding device 3 will be described later.

Figure 2:
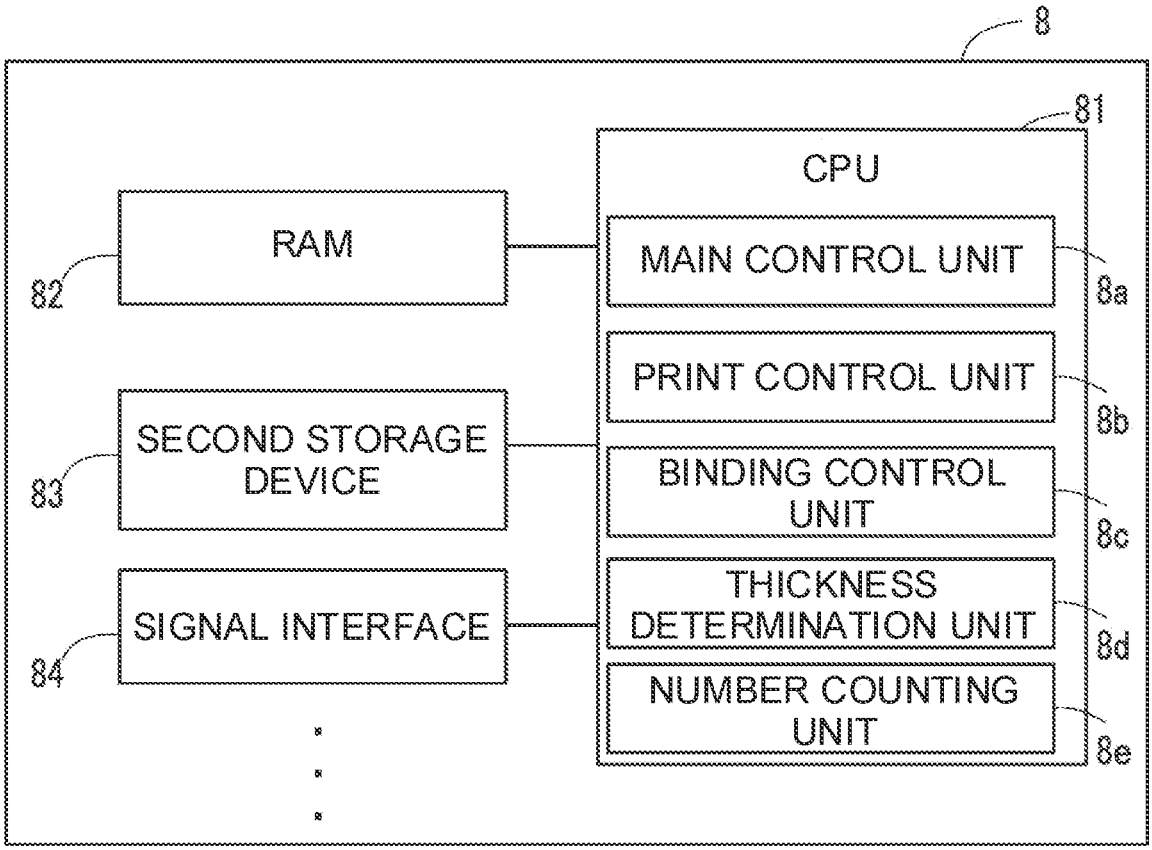
FIG. 2 is a block diagram illustrating a configuration of a control device in the image forming apparatus.

The control device 8 controls the devices included in the main body unit 1 and the post-processing unit 2. As shown in FIG. 2, the control device 8 includes a central processing unit (CPU) 81 and a peripheral device such as a random access memory (RAM) 82, a second storage device 83, and a signal interface 84.

A CPU 81 is a processor that executes various types of data processing and control by executing a computer program. A RAM 82 is a computer-readable volatile storage device. The RAM 82 temporarily stores the computer program executed by the CPU 81 and a data to be referred to in the process of the CPU 81 executing the various types of processing.

The second storage device 83 is a computer-readable non-volatile storage device. The second storage device 83 is capable of storing and updating the computer program and various types of data. For example, one or both of a flash memory or a hard disk drive may be employed as the second storage device 83.

The signal interface 84 converts signals output from various sensors included in the image forming apparatus 100 into digital data, and transmits the converted digital data to the CPU 81. Further, the signal interface 84 transmits the control signal output by the CPU 81 to devices to be controlled.

The CPU 81 of the control device 8 includes a plurality of processing modules that are implemented by executing the computer program. The plurality of processing modules include a main control unit 8*a*, a print control unit 8*b*, a binding control unit 8*c*, and the like.

The main control unit 8*a* executes a start control for starting the various types of processing in response to the operation performed on the operation device 801 and the control of the display device 802.

The print control unit 8*b* controls the printing apparatus 14.

For example, the print control unit 8*b* causes the printing apparatus 14 to execute the printing processing.

The binding control unit 8*c* controls the sheet binding device 3. In the present embodiment, the binding control unit 8*c* constitutes a part of the sheet binding device 3. For example, the binding control unit 8*c* causes the sheet binding device 3 to execute one of the processes specified in the first binding process and the second binding process.

The second binding process can bind a larger number of sheets 9 than the first binding process. However, the upper limit number of sheets 9 corresponding to each of the first binding process and the second binding process varies depending on a thickness of each of sheets 9 to be processed.

In some cases, the user may want to perform the first binding process preferentially, and to perform the second binding process only when the first binding process is impossible.

Moreover, setting the upper limit number of sheets for binding processing for each type of sheets 9 and setting the type of all sheets 9 that may be subject to processing is a complicated task for the user.

The sheet binding device 3 has a configuration in which the user can perform the first binding process without using a staple preferentially over the second binding process using a staple without the need for the user to consider the thickness of the sheet.

[Configuration of Sheet Binding Device 3]

Figure 3:
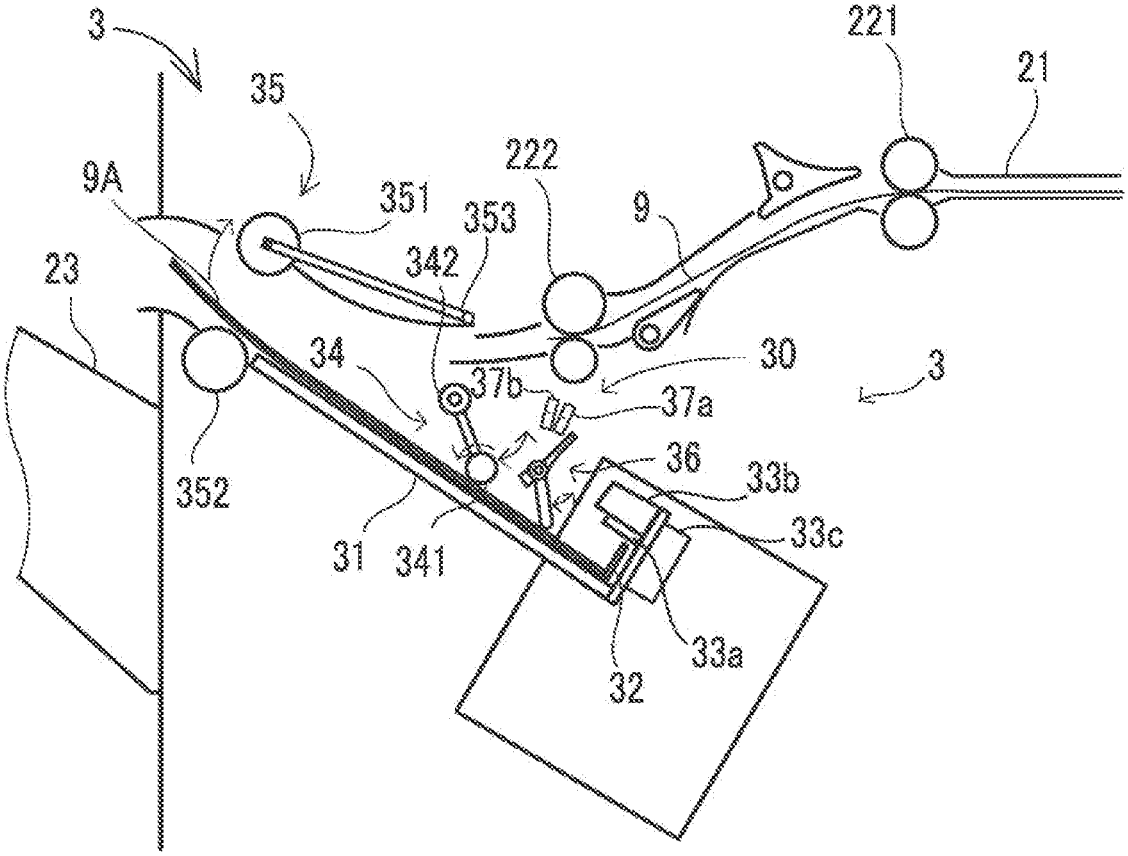
FIG. 3 is a configuration diagram of a sheet binding device according to an embodiment.

As shown in FIG. 3, the sheet binding device 3 includes a processing tray 31, an end supporting portion 32, a first binding unit 33*a*, a second binding unit 33*b*, a binding state switching mechanism (switching mechanism) 33*c*, an aligning rotation mechanism 34, a sheet discharge mechanism 35, and a thickness sensor 30.

The processing tray 31 is disposed so as to be inclined, and a plurality of sheets 9 fed out from above one by one by the pair of sending rollers 222 are stacked on the processing tray 31. In the following description, a plurality of sheets 9 stacked on the processing tray 31 are referred to as a stacked sheets 9A (see FIGS. 3,5,6). Note that the stacked sheets 9A are a sheet bundle composed of a plurality of sheets 9.

The end supporting portion 32 is erected in a portion close to an upstream end of the processing tray 31 in a sheet feed direction, and supports the rear end of the sheets 9 on the processing tray 31.

The aligning unit 34 includes an aligning member 341 and a movable support member 342. The movable support member 342 supports the aligning member 341 so as to be displaceable between a contact position in contact with the upper surface of the sheets 9 on the processing tray 31 and a retracting position away from the sheets 9.

Each time one sheet 9 is fed from above onto the processing tray 31, the aligning rotation mechanism 34 displaces the aligning member 341 from the retracting position to the contact position, and then displaces from the contact position to the retracting position.

The aligning member 341 rotates while being in contact with the upper surface of the sheets 9 on the processing tray 31 at the contact position, thereby urging the sheets 9 toward the end supporting portion 32. For example, the aligning member 341 is a roller on which an elastic layer such as a rubber layer having a large friction coefficient with respect to the sheet 9 is formed in the surface layer.

The aligning member 341 biases the sheets 9 on the processing tray 31 toward the end supporting portion 32, so that the rear ends of the sheets 9 in the stacked sheet 9A are aligned with the position of the end supporting portion 32.

It is also conceivable that the aligning member 341 is a plate-shaped elastic member protruding from a rotating shaft to be rotationally driven. In this case, the aligning member 341 makes contact with the upper surface of the sheets 9 so as to sweep the sheets 9 obliquely downward, every time the aligning member 341 rotates for one rotation. As a result, the aligning member 341 urges the sheets 9 toward the end supporting portion 32 each time the aligning member 341 rotates for one rotation.

The first binding unit 33*a* and the second binding unit 33*b* are disposed at positions closer to the end of the processing tray 31 on the side of the end supporting portion 32.

The first binding unit 33*a* performs the first binding process without using a staple on the lower edge portion of the stacked sheet 9A. The second binding unit 33*b* performs the second binding process using a staple on the lower edge portion of the stacked sheet 9A.

In the second binding process, the second binding unit 33*b* can bind a stacked sheet 9A having a thickness greater than that of the first binding process.

The binding state switching mechanism 33*c* moves the first binding unit 33*a* and the second binding unit 33*b* to selectively switch the first binding unit 33*a* and the second binding unit 33*b* to one of a first standby state and a second standby state.

The first standby state is a state in which the first binding process by the first binding unit 33*a* can be performed. The second standby state is a state in which the second binding process by the second binding unit 33*b* can be performed.

The binding state switching mechanism 33*c* moves one of the first binding unit 33*a* and the second binding unit 33*b* to the operating position, and moves the other one of the first binding unit 33*a* and the second binding unit 33*b* to a retracting position that does not interfere with the target binding device. A state in which the first binding unit 33*a* is arranged at the operating position is the first standby state, and a state in which the second binding unit 33*b* is arranged at the operating position is the second standby state.

For example, the first binding unit 33*a* is supported so as to be movable between a first operating position corresponding to the corner portion of the stacked sheets 9A and a retracting position away from the edge of the stacked sheets 9A.

On the other hand, the second binding unit 33*b* is supported to be movable to the second operating position and the third operating position along the width direction of the processing tray 31, and also to be movable to the first operating position by being rotated by a predetermined angle at the end of the processing tray 31.

The binding state switching mechanism 33*c* moves the second binding unit 33*b* to the second operating position or the third operating position that does not interfere with the first binding unit 33*a*, and then moves the first binding unit 33*a* to the first operating position. As a result, the first binding unit 33*a* and the second binding unit 33*b* are shifted to the first standby state.

On the other hand, the binding state switching mechanism 33*c* moves the first binding unit 33*a* to the retracting position, and then moves the second binding unit 33*b* to the first operating position, the second operating position, or the third operating position. As a result, the first binding unit 33*a* and the second binding unit 33*b* are shifted to the second standby state.

The sheet discharge mechanism 35 executes a sheet discharge process for discharging the stacked sheets 9A onto the discharge tray 23. Normally, the sheet discharge mechanism 35 discharges the stacked sheets 9A on which the first binding process or the second binding process has been performed, onto the discharge tray 23. Note that the sheet discharge mechanism 35 can also discharge the stacked sheets 9A, which has not been subjected to any of the first binding process and the second binding process, onto the discharge tray 23.

In the example illustrated in FIG. 3, the sheet discharge mechanism 35 includes an upper discharge roller 351, a lower discharge roller 352, and a movable support mechanism 353. The lower discharge roller 352 is disposed on an extension line obliquely above the processing tray 31.

The movable support mechanism 353 supports the upper discharge roller 351 so as to come into contact with and separated from the lower discharge roller 352. The movable support mechanism 353 holds the upper discharge roller 351 at a retracting position separated from the stacked sheet 9A in the initial state.

Further, when discharging the stacked sheets 9A onto the discharge tray 23, the movable support mechanism 353 displaces the upper discharge roller 351 from the retracting position to the discharge position. The discharge position is a position of the upper discharge roller 351 that sandwiches the stacked sheet 9A between the discharge position and the lower discharge roller 352.

When the upper discharge roller 351 rotates at the discharge position, the stacked sheets 9A are discharged from the processing tray 31 to the discharge tray 23 with the upper discharge roller 351 and the lower discharge roller 352.

When the number of the stacked sheets 9A reaches the designated number of sheets, the binding control unit 8*c* causes one of the first binding unit 33*a* and the second binding unit 33*b* to execute one of the first binding process and the second binding process. Further, the binding control unit 8*c* causes the sheet discharge mechanism 35 to execute the sheet discharge processing.

For example, the number counting unit 8*e* counts the number of sheets of the stacked sheet 9A. The print control unit 8*b* sets the number of prints input to the operation device 801 as the designated number of sheets.

When the number of the stacked sheets 9A counted by the number-of-sheets counting unit 8*e* reaches the designated number of sheets, the binding control unit 8*c* executes one of the first binding process by the first binding unit 33*a* and the second binding process by the second binding unit 33*b*, which has been selected in advance, and then executes the sheet discharge processing by the sheet discharge mechanism 35.

The thickness sensor 30 detects a first over state in which the thickness of the stacked sheets 9A exceeds the first thickness or a second over state in which the thickness exceeds the second thickness.

The first thickness is a maximum thickness of the stacked sheet 9A capable of being subjected to the first binding process by the first binding unit 33*a*. The second thickness is a maximum thickness of the stacked sheet 9A capable of being subjected to the second binding process by the second binding unit 33*b*.

The detection position of the thickness sensor 30 is located at a portion between the aligning member 341 and the end supporting portion 32 in the stacked sheet 9A.

The thickness sensor 30 includes a swing member 36 and an object sensor 37. The swing member 36 is swingably supported above the processing tray 31.

Figure 4:
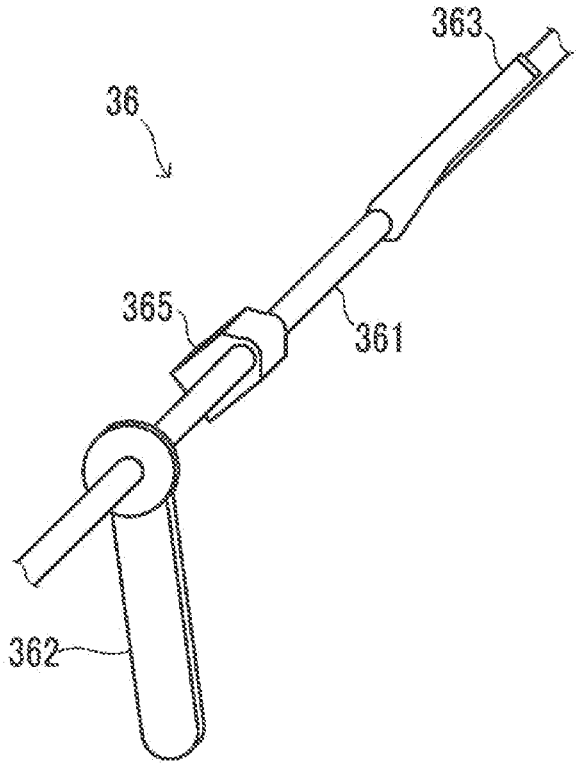
FIG. 4 is a perspective view of a swing member in the sheet binding device according to the embodiment.

As shown in FIG. 4, the swing member 36 includes a shaft portion 361, an arm portion 362, a detected portion 363, and a balancer 365.

The shaft portion 361 is rotatably supported by a frame of the post-processing unit 2. Accordingly, the swing member 36 is swingable about the shaft portion 361.

The arm portion 362 is formed so as to extend downward from the shaft portion 361. The distal end portion of the arm portion 362 is in contact with the detection position between the aligning member 341 and the end supporting portion 32 on the upper surface of the stacked sheet 9A, and thus swings up and down in accordance with the thickness of the stacked sheets 9A.

The detected portion 363 is formed so as to extend from the shaft portion 361 and displaced in conjunction with the swinging of the arm portion 362.

The first sensor 37*a* and the second sensor 37*b* detect the detected portion 363 in a part of the displacement range of the detected portion 363. In the present embodiment, each of the first sensor 37*a* and the second sensor 37*b* is a transmissive-type photosensor The first sensor 37*a* and the second sensor 37*b* may be a reflection-type photosensor, a contact-type micro-switch, and the like.

The first sensor 37*a* and the second sensor 37*b* may be a reflection-type photosensor, a contact-type micro-switch, and the like.

Figure 5:
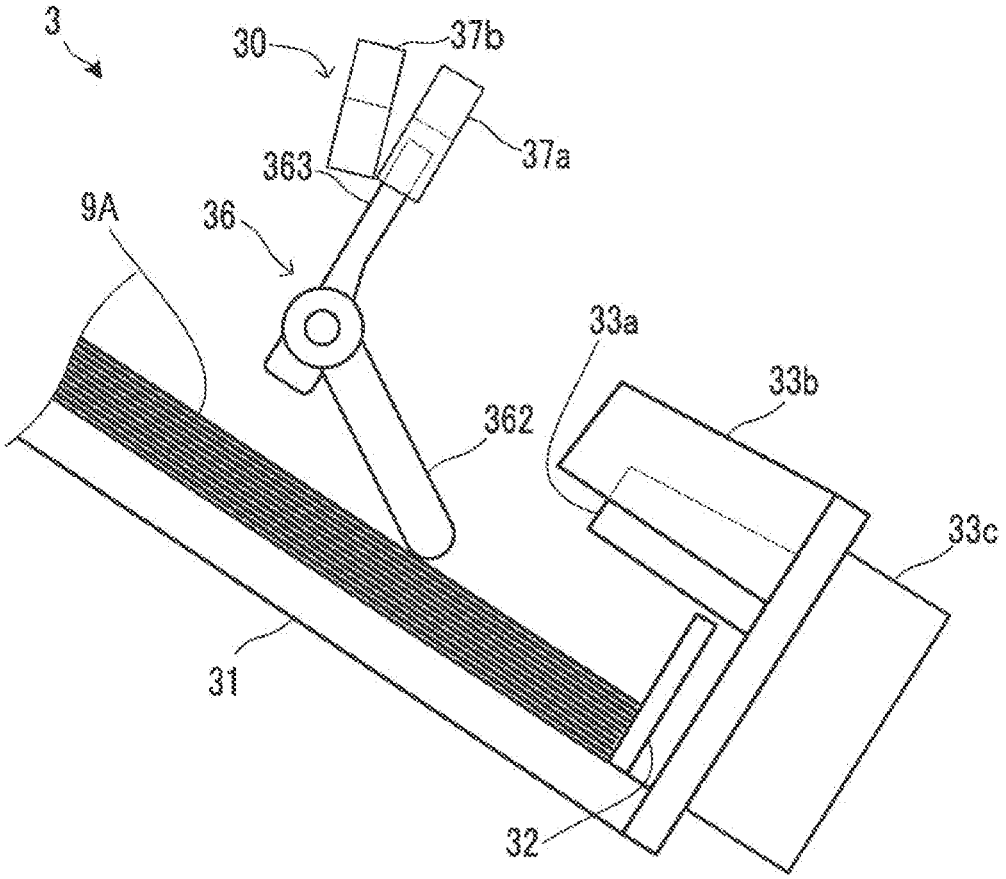
FIG. 5 is a diagram illustrating a state in which a thickness sensor in the sheet binding device according to the embodiment detects a sheet bundle having a thickness exceeding a first thickness.

The first sensor 37*a* detects the first over state in which the thickness of the stacked sheet 9A exceeds the first thickness by detecting the detected portion 363 in the first position. FIG. 5 shows a state in which the thickness sensor 30 detects the first over state.

Figure 6:
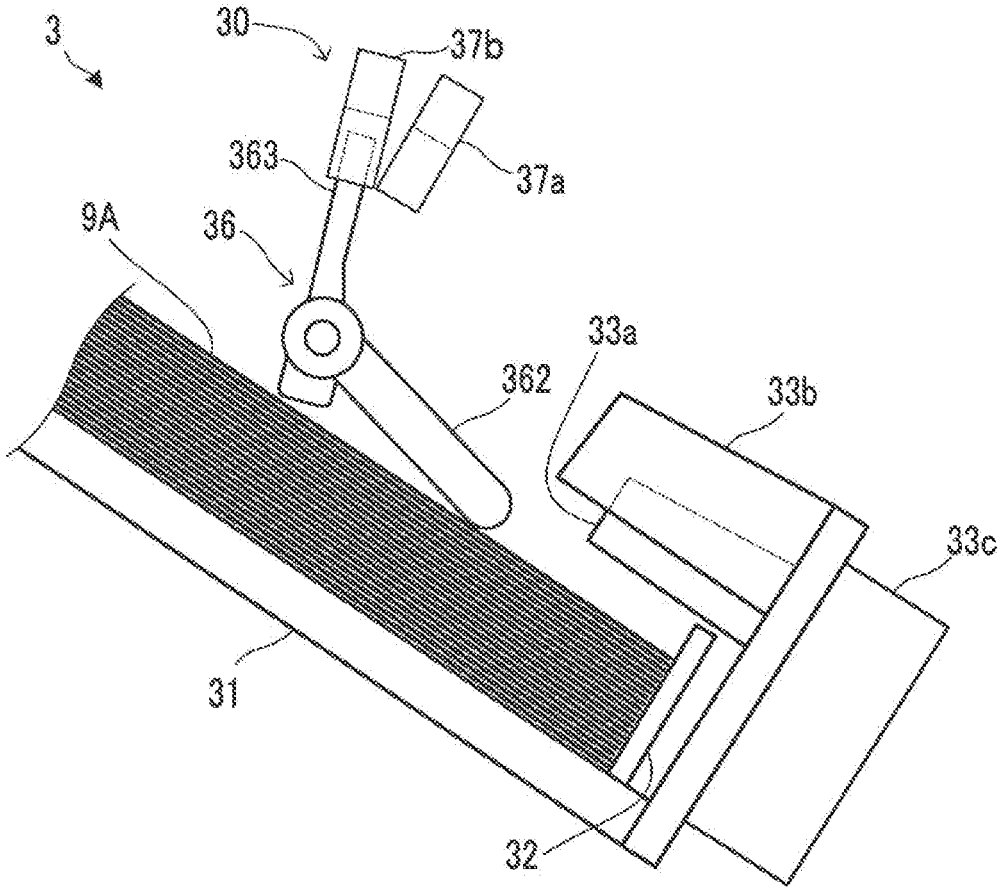
FIG. 6 is a diagram illustrating a state in which the thickness sensor in the sheet binding device according to the embodiment detects a second thickness over state.

On the other hand, the second sensor 37*b* detects that the distal end portion of the arm portion 362 has been displaced to a position corresponding to the second thickness by detecting the detected portion 363 at the second position in the displacement range of the detected portion 363. FIG. 6 shows a state in which the thickness sensor 30 detects the second thickness.

In the present embodiment, the CPU 81 of the control device 8 further includes a thickness determination unit 8*d* as one of the plurality of processing modules. The thickness determination unit 8*d* determines the thickness of the stacked sheet 9A based on the detection result of the object detected by the object sensor 37.

Specifically, the thickness determination unit 8*d* first determines that the thickness sensor 30 detects a reference state when the first sensor 37*a* and the second sensor 37*b* do not detect the detected portion 363. The reference state is a state in which the thickness of the stacked sheet 9A is equal to or less than the first thickness.

Further, the thickness determination unit 8*d* determines that the thickness sensor 30 detects the first over state when the first sensor 37*a* detects the detected portion 363 and the second sensor 37*b* does not detect the detected portion 363.

Further, the thickness determination unit 8*d* determines that the thickness sensor 30 detects the second over state when the first sensor 37*a* does not detect the detected portion 363 and the second sensor 37*b* detects the detected portion 363.

When determining that the thickness sensor 30 detects the second over state, the thickness determination unit 8*d* also determines that the first over state is detected.

In addition, the thickness determination unit 8*d* determines that the thickness sensor 30 is in an error state when the detection result of the object sensor 37 indicates a state other than the above-described state.

The thickness sensor 30 and the thickness determination unit 8*d* are examples of a first thickness detection unit that detects the first over state and a second thickness detection unit that detects the second over state.

Generally, the edge portion to which the staple processing is performed on the sheets 9 are often a portion in which an image is formed with a margin portion or with a relatively small amount of ink. In addition, the sheets 9 may be curved in some cases. Therefore, when the state of the thickness of the portion of the stacked sheets 9A away from the edge portion is detected, there is a possibility that a false detection occurs in which the state of the thickness of the portion subjected to the first binding process or the second binding process and the detection result are different from each other.

On the other hand, in the thickness sensor 30, the distal end portion of the arm portion 362 comes into contact with the vicinity of the edge portion of the stacked sheets 9A, on which the first binding process or the second binding process is performed. Therefore, the erroneous detection is less likely to occur.

Figure 7:
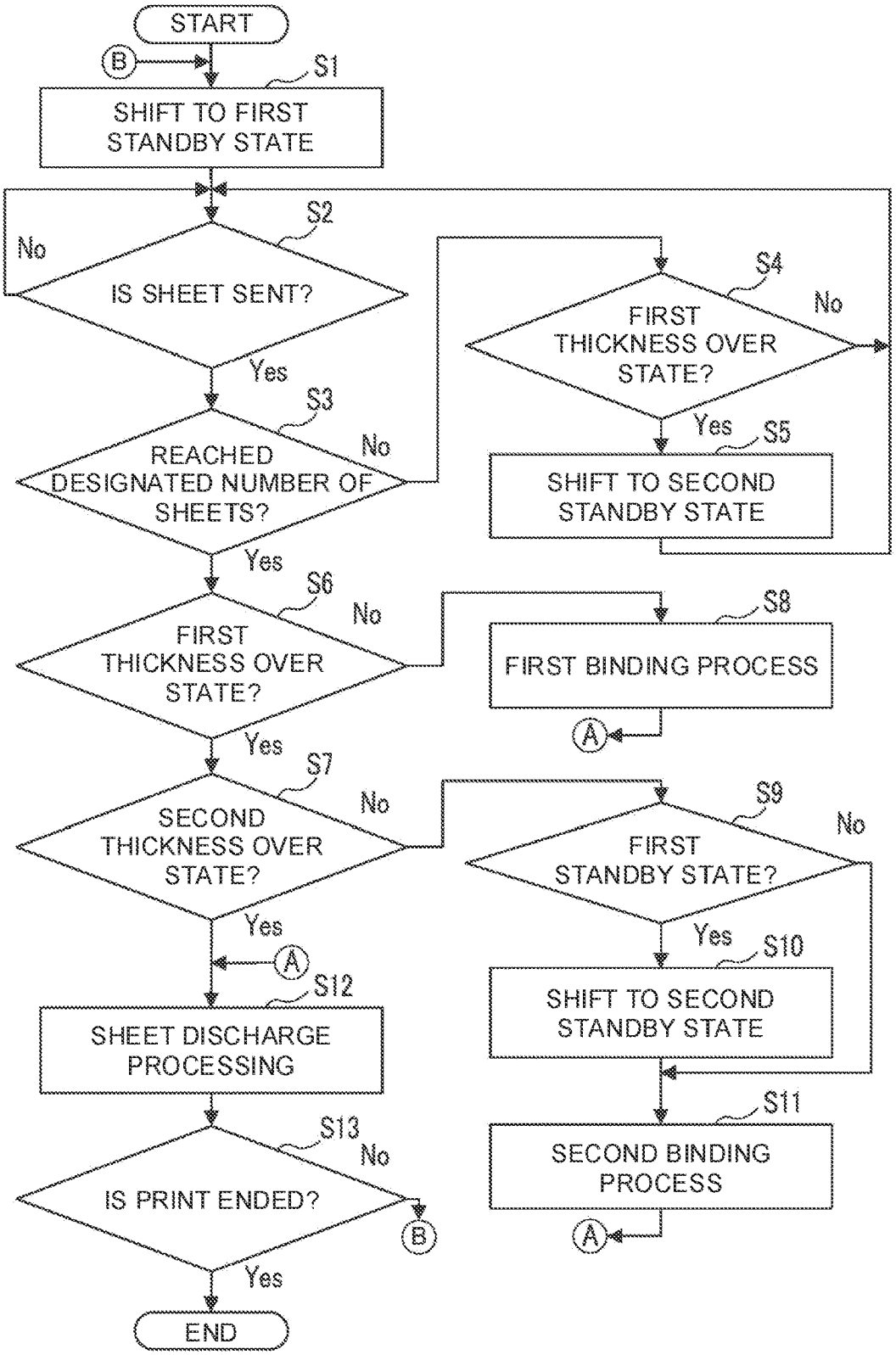
FIG. 7 is a flowchart illustrating an example of a procedure of sheet binding control when the staple-free binding priority mode is set in the sheet binding device according to the embodiment.

In the present embodiment, the binding control unit 8*c* performs the sheet binding control in the procedure illustrated in FIG. 7, for example, when the staple-free binding priority mode is set to the operation mode of the sheet binding device 3 in advance.

The staple-free binding priority mode is an operation mode in which the first binding process is performed preferentially, and the second binding process is executed in a case where the first binding process is not possible.

[Sheet Binding Control in Staple-Free Binding Priority Mode]

Hereinafter, an example of the procedure of the sheet binding control executed when the staple-free binding priority mode is set will be described with reference to the flowchart illustrated in FIG. 7.

The binding control unit 8*c* starts the sheet binding control illustrated in FIG. 7 when the print processing is started in a situation in which the staple-free binding priority mode is set.

In the following description, S1, S2, . . . represent identification signs of a plurality of steps in the sheet binding control.

In step S1, the binding control unit 8*c* controls the binding state switching mechanism 33*c* to transition the first binding unit 33*a* and the second binding unit 33*b* to the first standby state. Accordingly, the first binding unit 33*a* can promptly execute the first binding process. Thereafter, the binding control unit 8*c* proceeds to step S2.

In step S2, the binding control unit 8*c* determines whether or not a sheet 9 is newly sent onto the processing tray 31. Then, upon determining that the sheet 9 is newly sent onto the processing tray 31, the binding control unit 8*c* proceeds to step S3.

For example, the binding control unit 8*c* determines that the sheet 9 is newly sent onto the processing tray 31 when a predetermined time has elapsed since the detection of the sheet 9 by a sensor that detects the sheet 9 in the first conveyance path 13 or the second conveyance path 21.

In step S3, the binding control unit 8*c* determines whether the number of the stacked sheets 9A has reached the designated number of sheets.

When the binding control unit 8*c* determines that the number of stacked sheets 9A has reached the designated number of sheets, the binding control unit 8*c* proceeds to step S6. Otherwise, the binding control unit 8*c* causes the processing to proceed to step S4.

In step S4, when the first over state is detected by the thickness sensor 30 and the thickness determination unit 8*d*, the binding control unit 8*c* proceeds to step S5. Otherwise, the binding control unit 8*c* skips the step S7 and repeats the process from step S2.

In step S5, the binding control unit 8*c* controls the binding state switching mechanism 33*c* to shift the first binding unit 33*a* and the second binding unit 33*b* to the second standby state. Accordingly, the second binding unit 33*b* can promptly execute the second binding process. Thereafter, the binding control unit 8*c* proceeds to step S1.

As described above, the binding control unit 8*c* controls the binding state switching mechanism 33*c* to shift the first binding unit 33*a* and the second binding unit 33*b* to the first standby state before the first sheet 9 is sent to the processing tray 31 (step S1).

Further, when the first over state is detected before the number of sheets 9A reaches the designated number of sheets, the binding control unit 8*c* controls the binding state switching mechanism 33*c* to shift the first binding unit 33*a* and the second binding unit 33*b* to the second standby state (step S5).

In step S6, the binding control unit 8*c* proceeds to step S7 when the thickness sensor 30 and the thickness determination unit 8*d* detect the first over state. Otherwise, the binding control unit 8*c* proceeds to step S8.

In step S7, the binding control unit 8*c* proceeds to step S12 when the thickness sensor 30 and the thickness determination unit 8*d* detect the second over state. Otherwise, the binding control unit 8*c* proceeds to step S9.

In step S8, the binding control unit 8*c* causes the first binding unit 33*a* to execute the first binding process, and subsequently, proceeds to step S12.

Note that, since the process in step S1 is previously executed, the first binding unit 33*a* and the second binding unit 33*b* are already in the first standby state, in step S8. Therefore, when the number of the stacked sheets 9A reaches the designated number of sheets, the first binding process is promptly performed in step S8.

In step S9, when the first binding unit and the second binding unit are in the first standby state, the binding control unit 8*c* proceeds to step S10. Otherwise, the binding control unit 8*c* skips the process of step S10 and proceeds to step S11.

In step S10, the binding control unit 8*c* controls the binding state switching mechanism 33*c* to shift the first binding unit 33*a* and the second binding unit 33*b* to the second standby state. Subsequently, the binding control unit 8*c* proceeds to step S11.

In step S11, the binding control unit 8*c* causes the second binding unit 33*b* to execute the second binding process, and subsequently, proceeds to step S12.

Note that when the first over state is detected before the number of the stacked sheets 9A reaches the designated number of sheets, in step S9, the first binding unit 33*a* and the second binding unit 33*b* are already shifted to the second standby state by the processing of step S5. In this case, when the number of the stacked sheets 9A reaches the designated number of sheets, the process S10 is skipped, and the second binding process is promptly executed in the process S11.

In step S12, the binding control unit 8*c* causes the sheet discharge mechanism 35 to execute the sheet discharge processing. Thereafter, the binding control unit 8*c* proceeds to step S13.

In step S13, the binding control unit 8*c* ends the binding control when the print processing is completed, and repeats the processing from step S1 when the printing processing is not completed.

In the binding control, the processes in steps S6 to S11 are examples of a binding selection control. The binding selection control includes a control of selecting processing to be adopted from among the first binding process and the second binding process in accordance with a detection state of the thickness of the predetermined portion in the stacked sheet 9A, and of causing the first binding unit 33*a* or the second binding unit 33*b* to execute the selected processing.

That is, when the number of stacked sheets 9A reaches the designated number of sheets, the binding control unit 8*c* executes the binding selection control in steps S6 to S11, and then causes the sheet discharge mechanism 35 to execute the sheet discharge process in step S12.

In the binding selection control of steps S6 to S11, the binding control unit 8*c* causes the first binding unit 33*a* to perform the first binding process when the first over state is not detected (step S8), and causes the second binding unit 33*b* to perform the second binding process when the second over state is detected (step S11).

More specifically, in the binding selection control in steps S6 to S11, the binding control unit 8*c* performs the processing by distinguishing a first situation, a second situation, and a third situation described below.

The first situation is a situation in which the first over state and the second over state are not detected.

In the first situation, the binding control unit 8*c* causes the first binding unit 33*a* to execute the first binding process (step S8).

The second situation is a situation in which the first over state has been detected and the second over state has not been detected. In the second situation, the binding control unit 8*c* causes the second binding unit 33*b* to execute the second binding process (step S11).

The third situation is a situation in which the second over state is detected. In the third situation, the binding control unit 8*c* does not operate any of the first binding unit 33*a* and the second binding unit 33*b* (Yes in step S7).

When the sheet binding device 3 is adopted, it is unnecessary to perform complicated operations such as an operation of setting the upper limit number of sheets for the first binding process for each type of the sheet 9 and an operation of setting the kinds of all sheets 9 that may be processed.

Therefore, by executing the binding control illustrated in FIG. 7, the sheet binding device 3 can perform the staple-free binding processing more preferentially than the staple binding processing without requiring complicated operation of the user.

FIRST APPLICATION EXAMPLE

In the first application example of the sheet binding device 3, it is conceivable that the binding control unit 8*c* executes the following confirmation process before the processing in step S11 in FIG. 7 is performed. The confirmation process is executed when the first over state is detected when the number of stacked sheets 9A reaches the designated number of sheets.

The confirmation process is a process of notifying a predetermined inquiry and determining whether or not a permission for the inquiry notification is input. For example, the binding control unit 8*c* outputs the inquiry notification on the display device 802, and determines the input status of the permission through the operation device 801.

The binding control unit 8*c* in the application example causes the first binding unit 33*a* to execute the first binding process in a case where the first over state is not detected in the binding selection control (step S8). This is the same as described above.

In addition, the binding control unit 8*c* in the application example notifies the inquiry before the processing in step S11 in the binding selection control, causes the second binding unit 33*b* to execute the second binding process when the permission for the inquiry is input (step S10), and when the permission is not input, the binding control unit 8*c* skips the process in step S11 and the processing proceeds to step S12.

That is, in the application example, the binding control unit 8*c* does not operate any of the first binding unit 33*a* and the second binding unit 33*b* when the permission is not input.

When the present application example is employed, the same effect as in the case where the sheet binding device 3 is employed can be obtained.

SECOND APPLICATION EXAMPLE

The thickness sensor 30 may be a transmissive-type photosensor including a light emitting portion and a light receiving portion that oppose each other in the width direction of the processing tray 31. In this case, the swing member 36 is omitted.

In the present application example, for example, the light emitting portion and the light receiving portion of the first photosensor detect the sheet 9 at a position spaced apart from the upper surface of the processing tray 31 by a distance corresponding to the first upper limit thickness.

Further, in the present application example, the light emitting portion and the light receiving portion of the second photosensor detect the sheet 9 at a position spaced apart from the upper surface of the processing tray 31 by a distance corresponding to the second upper limit thickness.

What is claimed is:

1. A sheet binding device comprising:

a processing tray on which a bundle of sheets formed by stacking a predetermined number of sheets carried in is stacked;

a first binding unit which performs a first binding process without using a staple for binding the sheet bundle having a thickness that is equal to or less than a first thickness;

a second binding unit which performs a second binding process using a staple for binding the sheet bundle having a thickness that is equal to or less than a second thickness that exceeds the first thickness;

a thickness detection unit which detects a thickness of the sheet bundle; and a binding control unit that executes the first binding process and the second binding process, wherein when the thickness of the sheet bundle detected by the thickness detection unit is less than or equal to the first thickness, the binding control unit preferentially executes the first binding process by the first binding unit, and when the thickness of the sheet bundle detected by the thickness detection unit exceeds the first thickness, the binding control unit executes the second binding process by the second binding unit, and wherein the thickness detection unit includes a first thickness detection unit that detects a first state in which the thickness of the sheet bundle exceeds the first thickness and a second thickness detection unit that detects a second state in which the thickness of the sheet bundle exceeds the second thickness, when the first state is not detected by the first thickness detection unit and the second state is not detected by the second thickness detection unit, the binding control unit executes the first binding process by the first binding unit, when the first state is detected and the second state is not detected, the binding control unit executes the second binding process by the second binding unit, and when the second state is detected, neither the first binding process nor the second binding process is executed.

2. The sheet binding device according to claim 1, further comprising:

a switching mechanism that selectively switches the first binding unit and the second binding unit to an operating position and a retracting position, wherein by the time when the first sheet is sent out to the processing tray, the binding control unit arranges the first binding unit in the operating position and the second binding unit in the retracting position by the switching mechanism; each time the sheet is fed on the processing tray, the thickness detection unit detects the thickness of the sheet bundle; and when the thickness of the sheet bundle exceeds the first thickness, the binding control unit switches the first binding unit to the retracting position, and the second binding unit to the operating position.

3. The sheet binding device according to claim 1, further comprising:

an end supporting portion that is provided facing a rear end of the processing tray in a sheet feeding direction and supports a rear end of the sheet on the processing tray; and an aligning member provided on a downstream side of the end supporting portion in the sheet feeding direction, which is in contact with an upper surface of the sheet on the processing tray and moves the sheet toward the end supporting portion, wherein the thickness detection unit detects a thickness of the sheet bundle at a position between the aligning member and the end supporting portion.

4. The sheet binding device according to claim 1, wherein when the thickness of the sheet bundle detected by the thickness detection unit exceeds the first thickness, the binding control unit notifies an inquiry as to whether or not the second binding process is permitted; in response to the inquiry, if the second binding process is permitted, the second binding process by the second binding unit is executed; and if the second binding process is not permitted, neither the first binding process nor the second binding process is executed.

5. The sheet binding device according to claim 1, wherein when the first state is detected and the second state is not detected, the binding control unit notifies an inquiry as to whether or not the second binding process is permitted; in response to the inquiry, if the second binding process is permitted, the second binding process is executed, and if the second binding process is not permitted, neither the first binding process nor the second binding process is executed, and when the second state is detected, neither the first binding process nor the second binding process is executed.

6. A image forming apparatus comprising:

a printing apparatus that executes printing processing for forming an image on a sheet; and the sheet binding device according to claim 1 that performs processing on the sheet on which the image is formed.

* * * * *